US011335317B2

(12) United States Patent
Christoph

(10) Patent No.: US 11,335,317 B2
(45) Date of Patent: May 17, 2022

(54) ROAD AND ENGINE NOISE CONTROL

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/764,810

(22) PCT Filed: Oct. 10, 2016

(86) PCT No.: PCT/IB2016/056046

§ 371 (c)(1),
(2) Date: Mar. 29, 2018

(87) PCT Pub. No.: WO2017/064603

PCT Pub. Date: Apr. 20, 2017

(65) Prior Publication Data

US 2018/0277090 A1 Sep. 27, 2018

(30) Foreign Application Priority Data

Oct. 16, 2015 (EP) ..... 15190169

(51) Int. Cl.
*G10K 11/178* (2006.01)

(52) U.S. Cl.
CPC .. *G10K 11/17883* (2018.01); *G10K 11/17823* (2018.01); *G10K 11/17825* (2018.01);
(Continued)

(58) Field of Classification Search
CPC ..... G10K 11/1785; G10K 11/17881; G10K 11/17823; G10K 11/17825;
(Continued)

(56) References Cited

U.S. PATENT DOCUMENTS 5,245,664 A 9/1993 Kinoshite et al.
2010/0014685 A1* 1/2010 Wurm ..... G10K 11/17881 381/71.11

(Continued)

FOREIGN PATENT DOCUMENTS

CN 101888223 A 11/2010
CN 104835490 A 8/2015

(Continued)

OTHER PUBLICATIONS

Machine translation of JP5-53589, 12 pages (Year: 1993).*

(Continued)

*Primary Examiner* — Ping Lee
(74) *Attorney, Agent, or Firm* — Brooks Kushman P.C.

(57) ABSTRACT

Exemplary road and engine noise control systems and methods include directly picking up road noise from a structural element of a vehicle to generate a first sense signal representative of the road noise, directly picking up engine noise from an engine of the vehicle to generate a second sense signal representative of the engine noise, and combining the first sense signal and the second sense signal to provide a combination signal representing the combination of the first sense signal and the second sense signal. The systems and methods further include broadband active noise control filtering to generate a filtered combination signal from the combination signal, converting the filtered combination signal provided by the active noise control filtering into anti-noise and radiating the anti-noise to a listening position in an interior of the vehicle. The filtered combination signal is configured so that the anti-noise reduces the noise at the listening position.

17 Claims, 4 Drawing Sheets

(52) U.S. Cl.
CPC .. *G10K 11/17854* (2018.01); *G10K 11/17857* (2018.01); *G10K 11/17881* (2018.01); *G10K 2210/129* (2013.01); *G10K 2210/1282* (2013.01); *G10K 2210/12821* (2013.01); *G10K 2210/3026* (2013.01); *G10K 2210/3027* (2013.01); *G10K 2210/3028* (2013.01); *G10K 2210/3031* (2013.01); *G10K 2210/501* (2013.01); *G10K 2210/512* (2013.01)

(58) Field of Classification Search
CPC ... G10K 2210/12821; G10K 2210/129; G10K 2210/3026–3028; G10K 2210/512; G10K 2210/501; G10K 2210/3031; G10K 2210/1282
See application file for complete search history.

(56) References Cited

U.S. PATENT DOCUMENTS

| | | | | |
|---|---|---|---|---|
| 2010/0124337 | A1* | 5/2010 | Wertz | G10K 11/1786 381/71.11 |
| 2010/0290635 | A1 | 11/2010 | Shridhar et al. | |
| 2011/0235693 | A1* | 9/2011 | Lee | H04S 7/00 375/224 |
| 2012/0257763 | A1* | 10/2012 | Bowden | G10K 11/178 381/71.4 |
| 2013/0156213 | A1* | 6/2013 | Pan | H04R 29/00 381/71.4 |
| 2016/0300559 | A1* | 10/2016 | Lee | G10K 11/178 |

FOREIGN PATENT DOCUMENTS

| | | | |
|---|---|---|---|
| EP | 2133866 | A1 | 12/2009 |
| EP | 2251860 | A1 | 11/2010 |
| JP | 5-53589 | * | 3/1993 |
| JP | 05-053589 | A | 3/1993 |
| JP | H06161466 | A | 6/1994 |
| JP | 2010264974 | A | 11/2010 |
| WO | 2015023707 | A1 | 2/2015 |

OTHER PUBLICATIONS

Second Office Action dated Mar. 24, 2021 for European Application No. 15190169.1 filed Oct. 16, 2015, 9 pgs.
English Translation of Office Action dated Oct. 23, 2020 for Japanese Application No. 2018-516458 filed Mar. 29, 2018, 6 pgs.
English Translation of Final Office Action dated May 19, 2021 for Japanese Application No. 2018-516458 filed Mar. 29, 2018, 9 pgs.
English Translation of First Office Action dated Jan. 26, 2022 for Chinese Application No. 201680059244.4 filed Oct. 10, 2016, 26 pgs.

* cited by examiner

ROAD AND ENGINE NOISE CONTROL

CROSS-REFERENCE TO RELATED APPLICATION

This application is the U.S. national phase of PCT Application No. PCT/IB2016/056046 filed on Oct. 10, 2016, which claims priority to EP Patent Application No. 15190169.1 filed on Oct. 16, 2015, the disclosures of which are incorporated in their entirety by reference herein.

FIELD

The disclosure relates to road and engine noise control systems and methods.

BACKGROUND

Road noise control (RNC) technology reduces unwanted road noise inside a car by generating anti-noise, i.e., sound waves that are opposite in phase to the sound waves to be reduced, in a similar manner as with active noise control (ANC) technology. RNC technology uses noise and vibration sensors to pick up unwanted noise and vibrations generated from tires, car body components, and rough road surfaces that cause or transfer noise and vibrations. The result of canceling such noise is a more pleasurable ride and it enables car manufacturers to use lightweight chassis materials, thereby increasing fuel mileage and reducing emissions. Engine order cancellation (EOC) technology uses a non-acoustic signal such as a repetitions-per-minute (RPM) sensor representative of the engine noise as a reference to generate a sound wave that is opposite in phase to the engine noise audible in the car interior. As a result, EOC makes it easier to reduce the use of conventional damping materials. In both systems, additional error microphones mounted in the car interior may provide feedback on the amplitude and phase to refine noise reducing effects. However, the two technologies require different sensors and different signal processing in order to observe road noise and engine order related noise so that commonly two separate systems are used side by side.

SUMMARY

An exemplary road and engine noise control system includes a first sensor configured to directly pick up road noise from a structural element of a vehicle and to generate a first sense signal representative of the road noise, a second sensor configured to directly pick up engine noise from an engine of the vehicle and to generate a second sense signal representative of the engine noise, and a combiner configured to combine the first sense signal and the second sense signal to provide a combination signal representing a combination of the first sense signal and the second sense signal. The system further includes a broadband active noise control filter configured to generate a filtered combination signal from the combination signal, and a loudspeaker configured to convert the filtered combination signal of the active noise control filter into anti-noise and to radiate the anti-noise to a listening position in an interior of the vehicle. The filtered combination signal is configured so that the anti-noise reduces the road noise and engine noise at the listening position.

An exemplary road and engine noise control method includes directly picking up road noise from a structural element of a vehicle to generate a first sense signal representative of the road noise, directly picking up engine noise from an engine of the vehicle to generate a second sense signal representative of the engine noise, and combining the first sense signal and the second sense signal to provide a combination signal representing a combination of the first sense signal and the second sense signal. The method further includes broadband active noise control filtering to generate a filtered combination signal from the combination signal, and converting the filtered combination signal provided by the active noise control filtering into anti-noise and radiating the anti-noise to a listening position in an interior of the vehicle. The filtered combination signal is configured so that the anti-noise reduces the road noise and engine noise at the listening position.

BRIEF DESCRIPTION OF THE DRAWINGS

The disclosure may be better understood by reading the following description of non-limiting embodiments in connection with the attached drawings, in which like elements are referred to with like reference numbers, wherein below.

DETAILED DESCRIPTION

Figure 1:
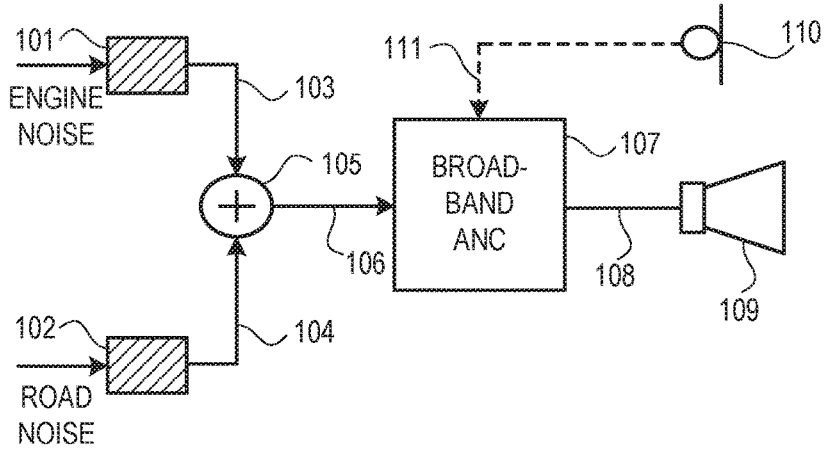
FIG. 1 is a schematic diagram illustrating a simple exemplary road and engine noise control system.

Noise is generally the term used to designate sound that does not contribute to the informational content of a receiver, but rather is perceived to interfere with the audio quality of a desired signal. The evolution process of noise can be typically divided into three phases. These are the generation of the noise, its propagation (emission) and its perception. It can be seen that an attempt to successfully reduce noise is initially aimed at the source of the noise itself, for example, by attenuation and subsequently by suppression of the propagation of the noise signal. Nonetheless, the emission of noise signals cannot be reduced to the desired degree in many cases. In such cases, the concept of removing undesirable sound by superimposing a compensation signal is applied.

Known methods and systems for canceling or reducing emitted noise suppress unwanted noise by generating cancellation sound waves to superimpose on the unwanted signal, whose amplitude and frequency values are for the most part identical to those of the noise signal, but whose phase is shifted by 180 degrees in relation to the noise. In ideal situations, this method fully extinguishes the unwanted noise. This effect of targeted reduction of the sound level of a noise signal is often referred to as destructive interference or noise control. In vehicles, the unwanted noise can be caused by effects of the engine, the tires, suspension and other units of the vehicle, and therefore varies with the speed, road conditions and operating states in the vehicle.

Common EOC systems utilize for the engine noise control a narrowband feed-forward active noise control (ANC) framework in order to generate anti-noise by adaptive filtering of a reference signal that represents the engine harmonics to be cancelled. After being transmitted via a secondary path from an anti-noise source to a listening position, the anti-noise has the same amplitude but opposite phase as the signals generated by the engine and filtered by a primary path that extends from the engine to the listening position. Thus, at the place where an error microphone resides in the room, i.e., at or close to the listening position, the overlaid acoustical result would ideally become zero so that error signals picked up by the error microphone would only record sounds other than the (cancelled) harmonic noise from the engine.

Commonly, a non-acoustical sensor such as a sensor measuring the repetitions-per-minute (RPM), is used as a reference. The signal from the RPM sensor can be used as a synchronization signal for generating an arbitrary number of synthesized harmonics corresponding to the engine harmonics. The synthesized harmonics form the basis for noise canceling signals generated by a subsequent narrowband feed-forward ANC system. Even if the engine harmonics mark the main contributions to the total engine noise, they by no means cover all noise components radiated by the engine, such as bearing play, chain slack, or valve bounce. However, an RPM sensor based system is not able to cover signals other than the harmonics.

In common RNC systems, airborne and structure-borne noise sources are monitored by noise and vibration sensors such as acceleration sensors in order to provide the highest possible road noise reduction performance. For example, acceleration sensors used as input noise and vibration sensors may be disposed throughout the vehicle to monitor the structural behavior of the suspension and other axle components. RNC systems utilize a broadband feed-forward active noise control (ANC) framework in order to generate anti-noise by adaptive filtering of the signal from the noise and vibration sensor that represents the road noise to be cancelled. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration and can be used to sense orientation, coordinate acceleration, motion, vibration, and shock.

As can be seen, the noise sensors and the subsequent signal processing in EOC and RNC systems are different. As the name suggests, EOC is only able to control engine orders. Other components of the engine signal that have a non-negligible acoustical impact and that cannot be controlled with the signal provided by a narrowband non-acoustic sensor (e.g., RPM sensor) cannot be counteracted with this system.

Referring to FIG. 1, a simple road and engine noise control system includes two broadband non-acoustic sensors, acceleration sensors 101 and 102, one of which, acceleration sensor 101, is provided to directly pick up engine noise, and the other sensor, acceleration sensor 102, is provided to directly pick up road noise. Directly picking up essentially includes picking up the signal in question without significant influence by other signals. Signals 103 and 104 output by the acceleration sensors 101 and 102 represent the engine noise and road noise, respectively, and are combined, e.g., summed up by an adder 105 to form a sum signal 106 representative of the combined engine and road noise. Alternative ways of combining signals may include subtracting, mixing, cross-over filtering etc. The sum signal 106 is supplied to a broadband ANC filter 107 which provides a filtered sum signal 108 to a loudspeaker 109. The filtered sum signal 108, when broadcasted by the loudspeaker 109 to a listening position (not shown), generates at the listening position anti-noise, i.e., sound with the same amplitude but opposite phase as the engine and road noise that appears at the listening position, in order to reduce or even cancel the unwanted noise at the listening position. The broadband ANC filter 107 may have a fixed or adaptive transfer function and may be a feedback system or a feed-forward system or a combination thereof. The acceleration sensor 101 may be substituted by an acoustic sensor under certain conditions. Furthermore, an error microphone 110 may be employed which picks up the residual noise at the listening position and provides an error signal 111 representative of the residual noise.

When an acoustic sensor is used to pick up engine noise, the sensor should not be prone to pick up acoustical feedback signals from the loudspeaker. But if sufficiently well insulated from the loudspeaker, which may be the case if a microphone is directly mounted on the engine block at a preferred position (e.g. close to the crankshaft and valves) and sufficiently well decoupled from the sound in the interior by the front console and hood. An acoustic sensor similar to a stethoscope may be used to pick up exclusively the broadband engine noise signals.

In the road and engine noise control system shown in FIG. 1, a broadband (acoustic or non-acoustic) sensor is employed in connection with accordingly adapted broadband signal processing to pick-up the complete engine noise, in contrast to common EOC systems which use narrowband feed-forward ANC. Since not only the narrowband harmonic components of the engine noise are processed, but rather broadband engine noise as well, it seems appropriate to differentiate between an engine order control (EOC) and engine noise control (ENC).

Furthermore, in this road and engine noise control system, the same ANC algorithm is used in combination with an additional sensor for ENC. Since adaptation rates of narrowband feed-forward ANC systems as used in EOC are usually high, it is likely that the traceability property of a broadband engine noise control system will be worse than that of an EOC system, unless certain measures are taken. However, broadband RNC and the combination of ENC and RNC in one common framework enhances the efficiency of the overall system. Sensors that are able to pick up broadband engine noise signals require a subsequent signal processing other than the previously used narrowband feed-forward ANC system which is unable to cope with broadband reference signals. For example, a suitable ANC system is a broadband feed-forward ANC framework employing a least mean square (LMS) algorithm. If a filtered-x least mean square (FXLMS) algorithm has been chosen for this task, one efficient combination of these two algorithms may be as depicted in FIG. 2.

Figure 2:
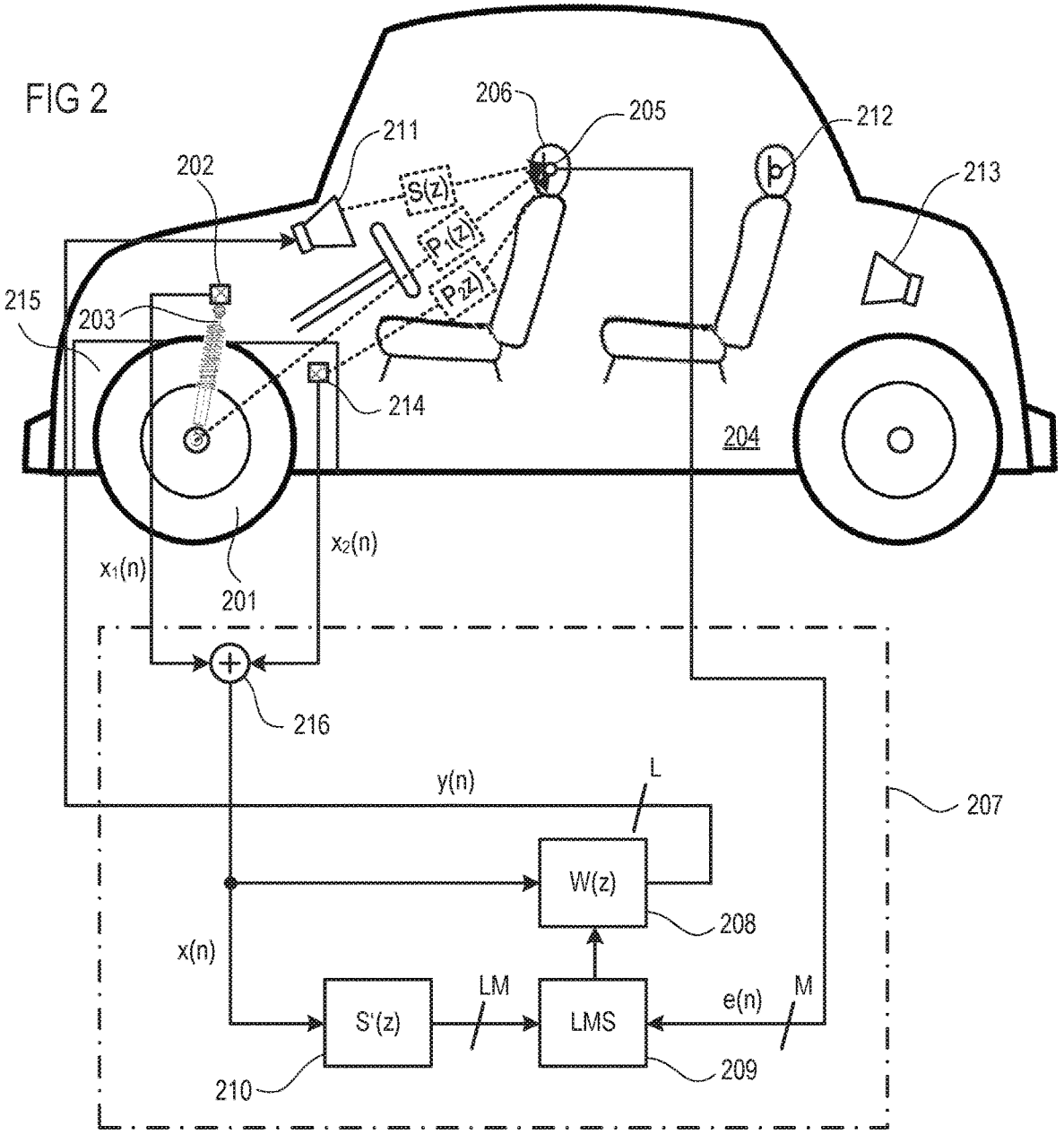
FIG. 2 is a schematic diagram illustrating an exemplary road and engine noise control system using a filtered-x least mean square algorithm.

A single-channel feedforward active road and engine noise control system with FXLMS algorithm is shown in FIG. 2. Noise (and vibrations) that originate from a wheel 201 moving on a road surface are directly picked up by an acceleration sensor 202 which is mechanically coupled with a suspension device 203 of an automotive vehicle 204 and which outputs a noise and vibration signal $x_1(n)$ that represents the detected noise (and vibrations) and, thus, correlates with the road noise audible within the cabin. The road noise originating from the wheel 201 is mechanically and/or acoustically transferred via a first primary path to the microphone 205 according to a transfer characteristic $P_1(z)$. Engine noise control includes another acceleration sensor 214 which is mounted to an engine 215 of the vehicle 204. Noise that originates from the engine 215 is directly picked up by the acceleration sensor 214 which outputs a noise signal $x_2(n)$ that represents the engine noise and, thus, correlates with the engine noise audible within the cabin. The engine noise originating from the engine 215 is mechanically and/or acoustically transferred via a second primary path to the microphone 205 according to a transfer characteristic $P_2(z)$. As the first primary path and the second primary path are quite similar, the transfer characteristics $P_1(z)$ and $P_2(z)$ can be assumed to be P(z). As signals $x_1(n)$ and $x_2(n)$ are both transferred via a transfer function P(z), the two signals can be summed up, e.g., by an adder 216 which provides a sum signal x(n).

At the same time, an error signal e(n) representing the sound including noise present in the cabin of the vehicle 204 is detected by a microphone 205 which may be arranged within the cabin in a headrest 206 of a seat (e.g., the driver's seat). A transfer characteristic W(z) of a controllable filter 208 is controlled by an adaptive filter controller 209 which may operate according to the known least mean square (LMS) algorithm based on the error signal e(n) and on the sum signal x(n) filtered with a transfer characteristic S'(z) by a filter 210, wherein $W(z)=-P(z)/S(z)$. $S'(z)=S(z)$ and S(z) represents the transfer function between the loudspeaker 211 and the microphone 205, i.e., the transfer function S(z) of a secondary path. A signal y(n) that, after having traveled through the secondary path, has a waveform inverse in phase to that of the road and engine noise audible within the cabin, is generated by an adaptive filter formed by controllable filter 208 and filter controller 209 based on the thus identified transfer characteristic W(z) and the sum signal x(n). From signal y(n), after it has traveled through the secondary path, sound with a waveform inverse in phase to that of the road and engine noise audible within the cabin is generated by the loudspeaker 211, which may be arranged in the cabin, to thereby reduce the road and engine noise within the cabin.

The exemplary system shown in FIG. 2 employs a straightforward single-channel feedforward filtered-x LMS control structure 207, but other control structures, e.g., multi-channel structures with a multiplicity of additional channels, a multiplicity of additional microphones 212, and a multiplicity of additional loudspeakers 213, may be applied as well. For example, in total, L loudspeakers and M microphones may be employed. Then, the number of microphone input channels into filter controller 209 is M, the number of output channels from filter 208 is L and the number of channels between filter 210 and filter control 209 is L·M.

Figure 3:
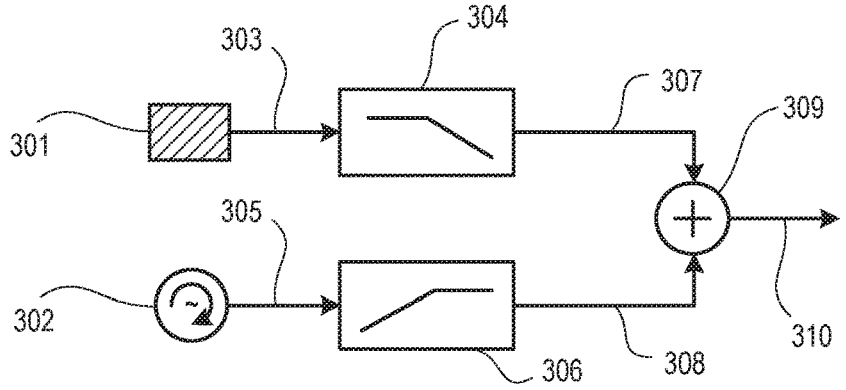
FIG. 3 is a schematic diagram illustrating an exemplary combination of acceleration sensor and an RPM sensor.

To pick-up engine noise, an acceleration sensor 301 may be combined with an RPM sensor 302 as shown in FIG. 3. A sense signal 303 output by acceleration sensor 301 is filtered by a subsequent low-pass-filter 304 and a sense signal 305 output by RPM sensor 302 is filtered by a subsequent high-pass filter 306. A filtered sense signal 307 output by low-pass-filter 304 and a filtered sense signal 308 output by high-pass filter 306 are summed up by means of an adder 309 to provide a reference signal 310. The low-pass-filter 304 and the high-pass filter 306 form a cross-over network so that signal components in the lower frequency range of the reference signal 310 originate from the acceleration sensor 301 and signal components in the higher frequency range of the reference signal 310 originate from the RPM sensor 302. In the example shown in FIG. 3, the RPM sensor 302 outputs a square-wave signal with a single frequency that corresponds to the RPM of the engine. Alternatively, the high-pass filter 306 may be substituted by a harmonic generator that generates harmonics of the single frequency that corresponds to the RPM of the engine, wherein the harmonics may be restricted to harmonics at only higher frequencies.

Figure 4:
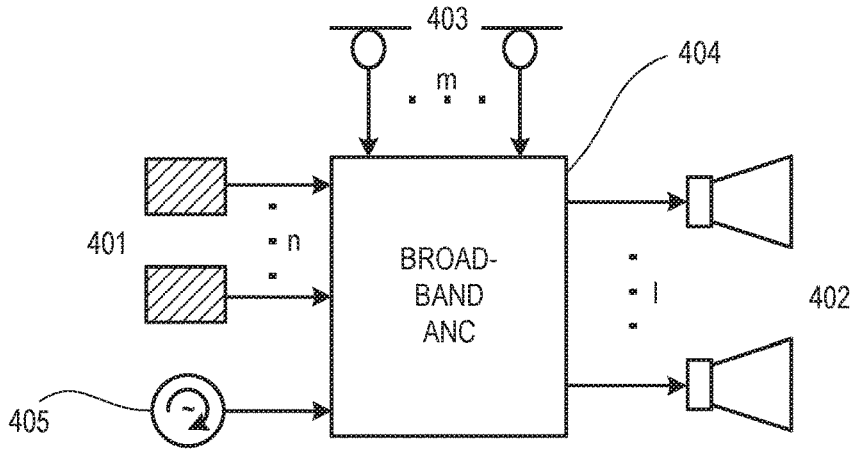
FIG. 4 is a schematic diagram illustrating an exemplary multi-channel active engine noise control system with a square-wave RPM input.

FIG. 4 shows an active engine noise control system which is a multi-channel type system capable of suppressing noise from a plurality of sensors. The system shown in FIG. 4 comprises n acceleration sensors 401, 1 loudspeakers 402, m microphones 403, and an adaptive active noise control module 404 which operates to minimize the error between noise from noise and vibration sources of the engine (primary noise) and cancelling noise (secondary noise). The adaptive active noise control module 404 may include a number of control circuits provided for each combination of microphones 403 and loudspeakers 402, wherein the loudspeakers 402 create cancelling signals for cancelling noise from the noise and vibration sources. The active engine noise control system further includes an RPM sensor 405 that is connected to the adaptive active noise control module 404. The RPM sensor 405 may provide a square-wave signal that corresponds to the RPM of the engine to the adaptive active noise control module 404. The acceleration sensors 401 may each be linked to a specific (matrix-wise) combination of one of microphones 402 and one of loudspeakers 402, which can each be seen as a single channel system.

Figure 5:
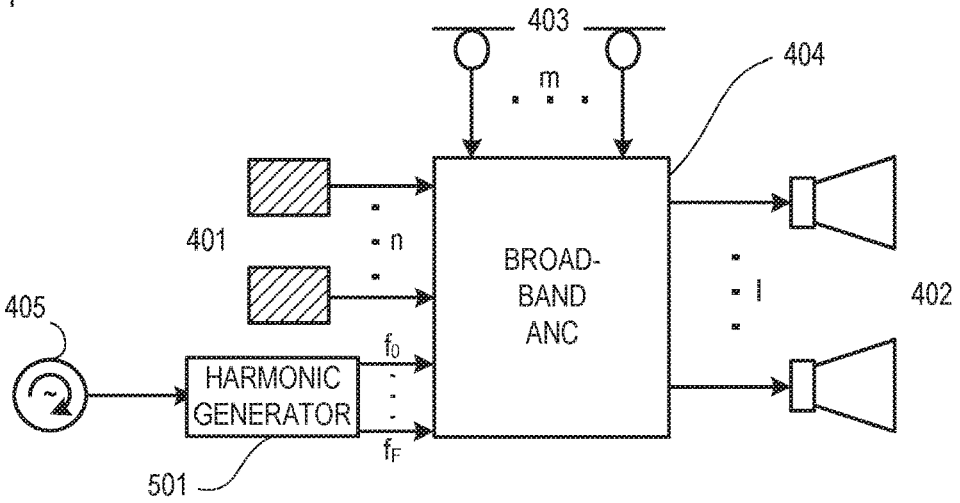
FIG. 5 is a schematic diagram illustrating the system shown in FIG. 4 with a harmonics input instead of the square-wave RPM input.
Figure 6:
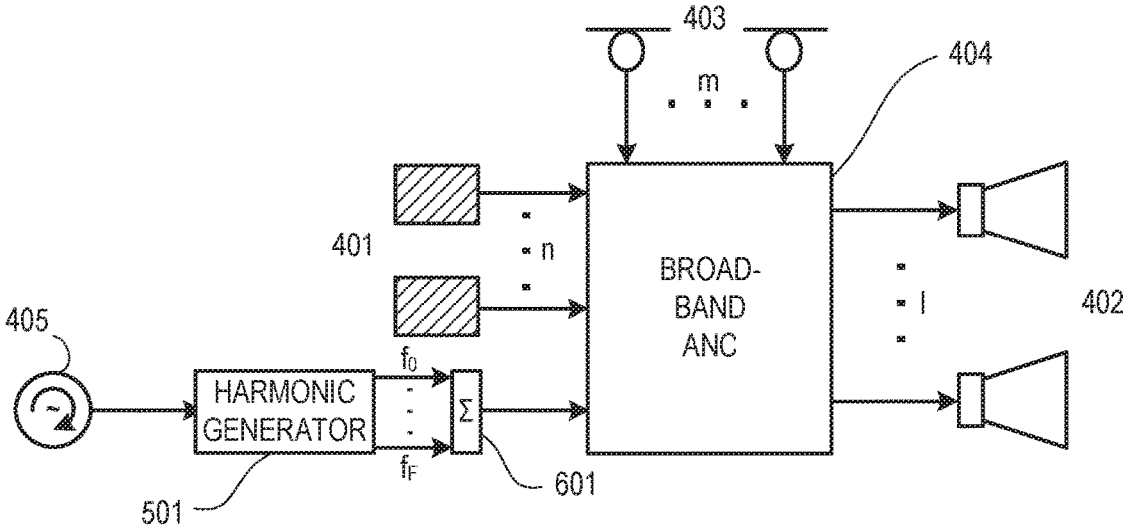
FIG. 6 is a schematic diagram illustrating the system shown in FIG. 4 with a summed-up harmonics input instead of the square-wave RPM input.

Referring to FIG. 5, the system shown in FIG. 4 may be modified so that the square wave output by the RPM sensor 405 is supplied to the adaptive active noise control module 404 via a harmonic generator 501 that synthesizes harmonics $f_0$ to $f_F$ from the fundamental frequency, i.e., first harmonic $f_0$, determined by the square-wave signal from the RPM sensor 405. Either all harmonics are input into the adaptive active noise control module 404 separately as shown in FIG. 5 or are summed up by a summer 601 to provide a single input as shown in FIG. 6. In the systems described above in connection with FIGS. 4 to 6, at least one of the acceleration sensors may be provided to pick up road noise so that these systems can be used for combined control of engine orders, engine noise and road noise.

Figure 7:
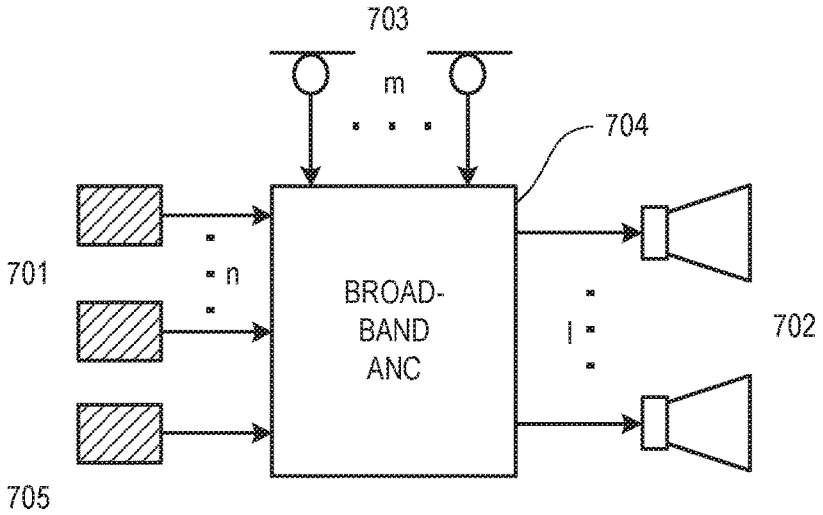
FIG. 7 is a schematic diagram illustrating an exemplary multi-channel road and engine noise control system.

FIG. 7 shows a multi-channel active road and engine noise control system which is a multi-channel type system capable of suppressing noise from a plurality of sensors. The system shown in FIG. 7 comprises n acceleration sensors 701, 1 loudspeakers 702, m microphones 703, and an adaptive active noise control module 704 which operates to minimize the error between noise from noise and vibration sources of the road (primary noise) and cancelling noise (secondary noise). The adaptive active noise control module 704 may include a number of control circuits provided for each combination of microphones 703 and loudspeakers 702, wherein the loudspeakers 702 create canceling signals for canceling noise from the road noise and vibration sources. The active road and engine noise control system further includes an additional acceleration sensor 705 that is connected to the adaptive active noise control module 704. The additional acceleration sensor 705 may provide a signal that corresponds to the acceleration acting on the engine to the adaptive active noise control module 704. The acceleration sensors 701 and acceleration sensor 705 may each be linked to a specific combination of one of microphones 703 and one of loudspeakers 702, each of which form a single channel system.

Figure 8:
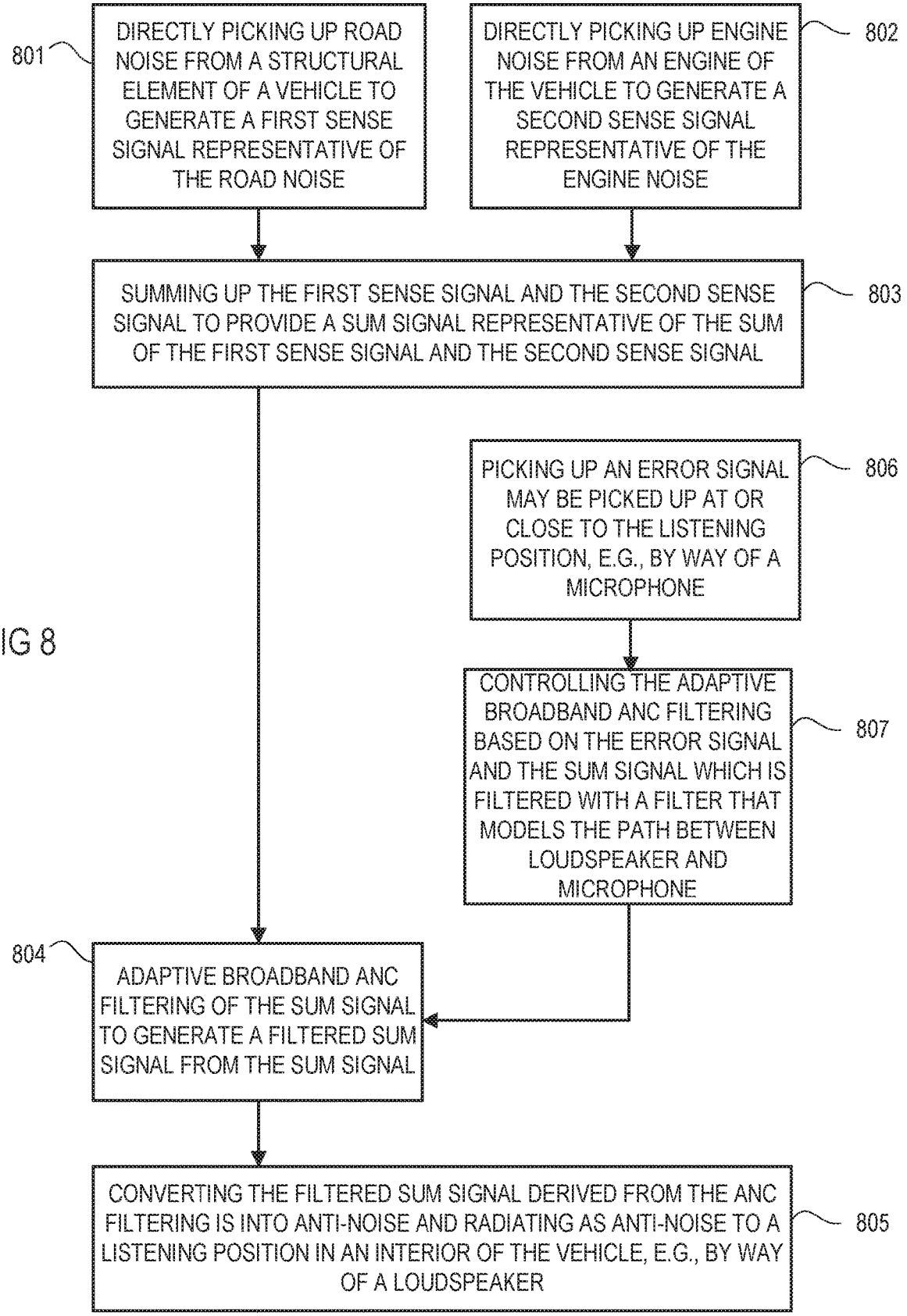
FIG. 8 is a flow chart illustrating an exemplary road and engine noise control method.

Referring to FIG. 8, an exemplary road and engine noise control method, as may be performed by one of the systems shown in FIGS. 1 and 2, may include directly picking up road noise from a structural element of a vehicle to generate a first sense signal representative of the road noise (procedure 801) and directly picking up engine noise from an engine of the vehicle to generate a second sense signal representative of the engine noise (procedure 802). The first sense signal and the second sense signal are combined, e.g., summed up to provide a sum signal representing the sum of the first sense signal and the second sense signal (procedure 803). The sum signal undergoes adaptive broadband ANC filtering, e.g., according to the FXLMS algorithm, to generate a filtered sum signal from the sum signal (procedure 804). Then, the filtered sum signal derived from the active noise control filtering is converted into anti-noise, e.g., by way of a loudspeaker, and radiated as anti-noise to a listening position in an interior of the vehicle (procedure 805). The filtered sum signal is configured so that the anti-noise reduces the road noise and engine noise at the listening position. Furthermore, an error signal may be picked up at or close to the listening position, e.g., by means of a microphone (procedure 806). The error signal and the sum signal, which is filtered with a filter that models the path between loudspeaker and microphone, are used to control the FXLMS algorithm of the adaptive broadband ANC filtering (procedure 807).

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The invention claimed is:

1. A road and engine noise control system comprising:

a first sensor including a first acceleration sensor configured to directly pick up road noise from a structural element of a vehicle and to generate a first sense signal representative of the road noise;

a second sensor including a second acceleration sensor attached to an engine and configured to directly pick up engine noise from the engine of the vehicle and to generate a second sense signal representative of non-harmonic engine noise;

a combiner configured to combine the first sense signal and the second sense signal to provide a combination signal representing the combination of the first sense signal and the second sense signal;

a loudspeaker configured to radiate anti-noise to a listening position in an interior of the vehicle in response to an anti-noise signal; wherein, the first acceleration sensor is attached to the structural element of the vehicle, a third sensor is positioned about the engine and includes a revolutions per minute (RPM) sensor configured to generate an RPM signal including a single fundamental frequency, the RPM signal being indicative of the RPM of the engine at the single fundamental frequency, the second acceleration sensor is directly attached to the engine to generate the second sense signal that is indicative of the non-harmonic engine noise that is not included in the RPM signal and to further sense engine noise components related to one or more of bearing play, chain slack, and valve bounce; and a broadband active noise control filter configured to generate the anti-noise signal for transmission to the loudspeaker with the combination signal and the RPM signal, wherein the anti-noise signal accounts for at least the RPM of the engine and for the non-harmonic engine noise that is not included in the RPM signal.

2. The system of claim 1, wherein the broadband active noise control filter comprises:

a controllable filter connected downstream of the combiner and upstream of the loudspeaker; and a filter controller configured to receive the combination signal and the RPM signal and to control the controllable filter according to the combination signal and the RPM signal.

3. The system of claim 2, further comprising a microphone disposed in the interior of the vehicle close or adjacent to the listening position, wherein the microphone is configured to provide a microphone signal and the filter controller is configured to further control the controllable filter according to the microphone signal.

4. The system of claim 2, wherein the filter controller is configured to control the controllable filter according to a least mean square algorithm.

5. The system of claim 1, further comprising:

a first microphone configured to provide a first microphone signal to the broadband active noise control filter;

a second microphone configured to provide a second microphone signal to the broadband active noise control filter; and an additional loudspeaker to generate a canceling signal to cancel noise for road noise and vibration sources.

6. The system of claim 5, wherein each of the first acceleration and the second acceleration sensor is linked to a combination of one of the first microphone and the second microphone and of the loudspeaker and the additional loudspeaker to form a multi-channel system to suppress noise.

7. A road and engine noise control method comprising:

directly picking up road noise, via a first acceleration sensor, from a structural element of a vehicle to generate a first sense signal representative of the road noise, directly picking up engine noise, via a second acceleration sensor that is attached to an engine, from the engine of the vehicle to generate a second sense signal representative of non-harmonic engine noise;

combining the first sense signal and the second sense signal to provide a combination signal representing the combination of the first sense signal and the second sense signal;

radiating, via a loudspeaker, anti-noise to a listening position in an interior of the vehicle in response to an anti-noise signal;

wherein the first acceleration sensor is attached to the structural element of the vehicle, and generating, via a third sensor that includes a revolutions per minute (RPM) signal including a single fundamental frequency, the RPM signal being indicative of the RPM of the engine at the single fundamental frequency;

wherein the second acceleration sensor is directly attached to the engine to generate the second sense signal that is indicative of the non-harmonic engine noise that is not included in the RPM signal and to further sense engine noise components related to one or more of bearing play, chain slack, and valve bounce; and generating the anti-noise signal via broadband active noise control filtering for transmission to the loudspeaker with the combination signal and the RPM signal, wherein the anti-noise signal accounts for at least the RPM of the engine and for the non-harmonic engine noise that is not included in the RPM signal.

8. The method of claim 7, wherein the broadband active noise control filtering comprises controlled filtering of the combination signal and the RPM signal to provide the filtered combination signal to be converted into anti-noise, wherein the controlled filtering is based on the combination signal and the RPM signal.

9. The method of claim 8, further comprising picking up sound in the interior of the vehicle close or adjacent to the listening position to provide a microphone signal, wherein the controlled filtering is based on the microphone signal.

10. The method of claim 8, wherein the controlled filtering is based on a least mean square algorithm.

11. The method of claim 10, wherein combining includes summing the first sense signal and the second sense signal to provide a sum signal representing the sum of the first sense signal and the second sense signal.

12. A road and engine noise control system comprising:

a first sensor including a first acceleration sensor configured to pick up road noise from a structural element of a vehicle and to generate a first sense signal indicative of the road noise;

a second sensor including a second acceleration sensor attached to an engine and configured to pick up engine noise from the engine of the vehicle and to generate a second sense signal indicative of non-harmonic engine noise;

a combiner configured to combine the first sense signal and the second sense signal to provide a combination signal;

a loudspeaker configured to radiate anti-noise to a listening position in an interior of the vehicle in response to an anti-noise signal;

wherein the first acceleration sensor is attached to the structural element of the vehicle, and wherein a revolutions per minute (RPM) sensor is positioned about the engine and is being configured to generate an RPM signal including a single fundamental frequency, the RPM signal being indicative of the RPM of the engine at the single fundamental frequency;

wherein the second acceleration sensor is directly attached to the engine to generate the second sense signal that is indicative of the non-harmonic engine noise that is not included in the RPM signal and to further sense engine noise components related to one or more of bearing play, chain slack, and valve bounce; and a broadband active noise control filter configured to generate the anti-noise signal for transmission to the loudspeaker with the combination signal and the RPM signal, wherein the anti-noise signal accounts for at least the RPM of the engine and for the non-harmonic engine noise that is not included in the RPM signal.

13. The system of claim 12, wherein the broadband active noise control filter comprises:

a controllable filter connected to the combiner and to the loudspeaker; and a filter controller configured to receive the combination signal and the RPM signal and to control the controllable filter according to the combination signal and the RPM signal.

14. The system of claim 13, further comprising a microphone disposed in the interior of the vehicle close or adjacent to the listening position, wherein the microphone is configured to provide a microphone signal and the filter controller is configured to further control the controllable filter based on the microphone signal.

15. The system of claim 13, wherein the filter controller is configured to control the controllable filter based on a least mean square algorithm.

16. The system of claim 12, further comprising:

a first microphone configured to provide a first microphone signal to the broadband active noise control filter;

a second microphone configured to provide a second microphone signal to the broadband active noise control filter; and an additional loudspeaker to generate a canceling signal to cancel noise for road noise and vibration sources.

17. The system of claim 16, wherein each of the first acceleration and the second acceleration sensor is linked to a combination of one of the first microphone and the second microphone and of the loudspeaker and the additional loudspeaker to form a multi-channel system to suppress noise.

* * * * *